US006148519A

United States Patent [19]

Stenersen et al.

[11] Patent Number: 6,148,519

[45] Date of Patent: Nov. 21, 2000

[54] APPARATUS FOR INSTALLING A PACKING MATERIAL IN A MUFFLER ASSEMBLY; AND METHODS THEREOF

[75] Inventors: Eivind Stenersen, River Falls, Wis.; Wayne M. Wagner, Apple Valley; Daniel T. Risch, Burnsville, both of Minn.

[73] Assignee: Donaldson Company, Inc., Minneapolis, Minn.

[21] Appl. No.: 09/156,834

[22] Filed: Sep. 18, 1998

[51] Int. Cl.[7] ..... B23P 15/00

[52] U.S. Cl. ..... 29/890.08; 29/446; 29/451

[58] Field of Search ..... 29/446, 451, 890.08

[56] References Cited

U.S. PATENT DOCUMENTS

| | | |
|---|---|---|
| Re. 32,258 | 10/1986 | Kondo et al. . |
| 2,366,935 | 1/1945 | Schmid . |
| 2,809,709 | 10/1957 | Billey . |
| 2,853,148 | 9/1958 | Billey . |
| 2,910,814 | 11/1959 | Yelinek . |
| 2,940,538 | 6/1960 | Billey . |
| 3,026,610 | 3/1962 | Wakefield . |
| 3,458,966 | 8/1969 | Dunbar et al. . |
| 3,630,030 | 12/1971 | Wagner . |
| 3,672,464 | 6/1972 | Rowley et al. . |
| 3,776,364 | 12/1973 | Van Doeren . |
| 3,786,897 | 1/1974 | Swanson . |
| 3,921,273 | 11/1975 | Kondo et al. . |
| 3,957,132 | 5/1976 | Swanson . |
| 4,023,645 | 5/1977 | Retka et al. . |
| 4,085,881 | 4/1978 | Roberson . |
| 4,113,289 | 9/1978 | Wagner et al. . |
| 4,240,193 | 12/1980 | Krein . |
| 4,267,899 | 5/1981 | Wagner et al. . |
| 4,270,689 | 6/1981 | Canfield . |
| 4,273,161 | 6/1981 | McLaughlin . |

(List continued on next page.)

FOREIGN PATENT DOCUMENTS

| | | |
|---|---|---|
| 0 091 413 | 10/1983 | European Pat. Off. . |
| 0 153 100 A1 | 8/1985 | European Pat. Off. . |
| 0 353 418 A2 | 2/1990 | European Pat. Off. . |
| 295 21 583 U 1 | 3/1998 | Germany . |
| 1 279 472 | 6/1972 | United Kingdom . |

OTHER PUBLICATIONS

Reinhart, T. E. et al., "Reducing Compression Brake Noise," *Society of Automotive Engineers, Inc.*, pp. 1–8 (Copyright 1997).

"Measurement Procedure for Determination of Silencer Effectiveness in Reducing Engine Intake or Exhaust Sound Level, SAE J1207," *Society of Automotive Engineers, Inc.*, 11 pages (Feb. 1987).

Wahl, T. J. et al., "Developing a Test Procedure for Compression Brake Noise," *Society of Automotive Engineers, Inc.*, pp. 1315–1325 (Copyright 1997).

*Primary Examiner*—Irene Cuda
*Attorney, Agent, or Firm*—Merchant & Gould P.C.

[57] ABSTRACT

A process for installing a fiber wrap or a packing material in a tubular construction, for example a muffler assembly, includes a step of compressing a mat of packing material by removing at least a portion of air from the mat of packing material. The mat is oriented against a tubular wall. After the step of orienting the mat, a shell, such as a muffler shell, is oriented over and against the mat. The step of compressing a mat may include drawing a partial vacuum through a perforated tubular wall, where the perforated tubular wall is the tubular wall that the mat is oriented against. Alternatively, the step of compressing a mat may include drawing a partial vacuum through the perforated wand inserted into the mat. Apparatus for installing the packing material can include a mandrel, a pump apparatus, and a sealing arrangement; or, the apparatus can include a wand and a vacuum pump.

16 Claims, 10 Drawing Sheets

U.S. PATENT DOCUMENTS

| | | |
|---|---|---|
| 4,378,622 | 4/1983 | Pinkston et al. . |
| 4,489,473 | 12/1984 | Nakagami . |
| 4,569,471 | 2/1986 | Ingemansson et al. . |
| 4,580,657 | 4/1986 | Schmeichel et al. . |
| 4,622,026 | 11/1986 | Ito et al. . |
| 4,632,216 | 12/1986 | Wagner et al. . |
| 4,676,111 | 6/1987 | Wagner et al. . |
| 4,969,637 | 11/1990 | Wagner et al. . |
| 5,036,585 | 8/1991 | Schweinfurth . |
| 5,123,501 | 6/1992 | Rothman et al. . |
| 5,355,973 | 10/1994 | Wagner et al. . |
| 5,426,269 | 6/1995 | Wagner et al. . |
| 5,461,777 | 10/1995 | Ikeda et al. . |

APPARATUS FOR INSTALLING A PACKING MATERIAL IN A MUFFLER ASSEMBLY; AND METHODS THEREOF

FIELD OF THE INVENTION

The present invention is related to processes for installing packing material, such as a fiber wrap, in an enclosed tubular construction. One such application is for constructing mufflers. The present invention also concerns apparatus for performing these processes contributing to the increase in the ease of assembly.

BACKGROUND OF THE INVENTION

Mufflers are well known to be used with engines in order to quiet the noise generated by the operation of engines. One type of muffling or sound reduction technique sometimes used is based on absorptive techniques. With absorptive muffling, the energy represented by the sound waves dissipates as heat. Generally, it results from passing or directing the sound waves over or through a packing, such as a fibrous packing. The packing absorbs and dissipates the energy of the sound waves by the sound energy being converted into motion of the fibers. Fiber density is an important factor to sound absorbing efficiency. Thus, it is important to provide consistent and controllable fiber density.

Another type of muffling technique sometimes used is shell damping. Sometimes the outer shell of the muffler vibrates and results in unwanted transmission of exhaust noise into the environment. Shell damping reduces the tendency of the muffler shell to vibrate as a result of the sound pressures within the muffler. Effective damping techniques include using fiberglass wraps and fibrous packing.

As can be seen, the use of packing material and fiber wraps in mufflers can lead to desirable muffler performance. Further, fiber wraps or packing material in mufflers can be useful for heat insulation purposes. Improved techniques for constructing mufflers that have such fiber wraps or packing are desirable.

SUMMARY OF THE INVENTION

In certain applications, this disclosure is directed to a process for installing a fiber wrap or a mat of packing material in a tubular construction. One example would be installing a packing material in a tubular construction. One specific example would be installing a packing material in a muffler assembly. The process includes a step of compressing a mat of packing material by removing at least a portion of air from the mat of packing material. For example, this may be accomplished by drawing sub atmospheric pressure (or a partial vacuum) through a perforated wall of the tubular construction. This tubular construction may include a perforated muffler wall. Alternatively, this may be accomplished by drawing sub atmospheric pressure through a wand inserted into the mat of packing material. Another step includes orienting a mat of packing material over and against the wall of the tubular construction. After this step of orienting the mat, there is a step of orienting a second tubular construction over and against the mat. For example, the second tubular construction may include a muffler is shell.

In one preferred process, before the step of drawing sub atmospheric pressure, there is a step of orienting the tubular construction wall over a mandrel. Preferably, after the step of orienting the tubular construction wall over a mandrel, there is a step of forming a seal between the tubular construction wall and the mandrel.

In certain applications, this disclosure concerns an apparatus for installing a packing material into a tubular construction. One example would be installing a fiber wrap in a muffler assembly. Certain apparatus, in accordance with the invention, includes a mandrel having an outer wall defining an interior, and the outer wall can include a plurality of apertures in air flow communication with the interior. A pump apparatus would be in air flow communication with the mandrel to induce sub atmospheric pressure in the mandrel interior and through the wall apertures. A sealing arrangement can be adjacent to the mandrel to provide a seal between the mandrel and a workpiece, such as a tubular construction for a muffler, when a workpiece is mounted on the mandrel.

In certain preferred embodiments, the sealing arrangement is mounted on a pair of hubs on opposite ends of the mandrel. The sealing arrangement can include inflatable seal members or other mechanical sealing constructions and methods.

In some embodiments, there is a dust collector in air flow communication with the pump apparatus and the mandrel interior. The dust collector can be used to trap loose fibers entered in the air flow used to generate the partial vacuum.

Still in other embodiments, the apparatus can include a silencer attached to the pump apparatus. This is to muffle or quiet the noise or sound pressure level emanating from the pump apparatus.

The disclosure concerns other improved processes and apparatus for carrying out these processes.

DETAILED DESCRIPTION OF THE PREFERRED EMBODIMENT

A. Some problems with Existing Processes

In existing processes, fiber wrap exists in a mat or sheet form. The fiberglass mat is positioned around a tubular wall and then wrapped with tape. If the tubular wall is used in a muffler assembly, when the muffler is operated, in theory, the tape melts from the heat of the exhaust gases. Once the tape melts, the fiber expands to help perform its functions of absorbing, damping, or thermal insulation.

Sometimes, the tape does not melt sufficiently. In those instances, the fiber does not expand to fill the chamber between the tubular wall and the outer shell. When this happens, body shell vibration and rattling is exasperated because the shell fits loosely rather than tightly around the remaining portions of the subassembly (in this example, a muffler). In addition, the absorptive performance of the fiber mat is compromised by continued compression of the mat.

Further, wrapping tape around the mat is a time consuming process. It adds to delays and expense on the assembly line. To tape and work with fiberglass mat material is difficult. Moreover, if the tape is not applied tightly or completely enough, it becomes difficult to place the outer shell over the mat. This can be frustrating for workers on the assembly line. At times, workers on the assembly line may adjust the tolerance of the diameter of the inner tubular construction to ensure that the inner tubular construction with the mat fits easily within the outer shell. This contributes further to a loose fitting shell and the resulting shell noise due to vibration and rattling.

The processes and apparatus described herein address these and other problems.

B. The Apparatus of FIGS. 1–10

Figure 1:
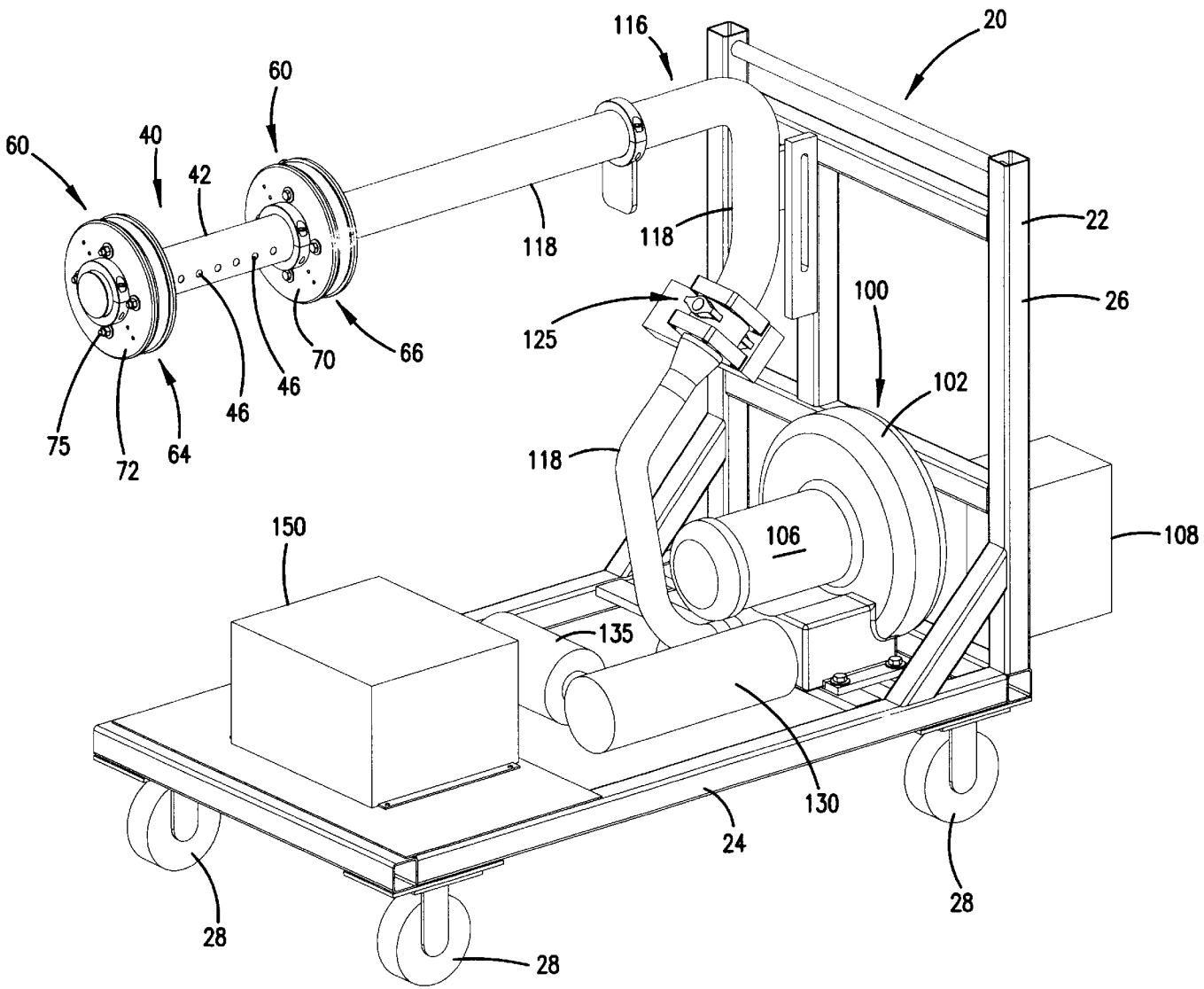
FIG. 1 is a perspective view of one embodiment of an apparatus for installing fiber wrap into a tubular construction, in accordance with principles of the present invention.

In reference now to FIG. 1, one example apparatus constructed in accordance with the present invention is illustrated generally at 20. Apparatus 20 preferably includes a frame 22. Frame 22 includes a platform section or deck 24 and an upright portion 26 cantilevered from the deck 24. Preferably, the frame 22 including the deck 24 and upright portion 26 is constructed of a rigid, durable material suitable for supporting the weight of the remaining portions of the apparatus.

As can be seen in FIG. 1, frame 22 preferably includes a plurality of wheels 28 for providing mobility for the apparatus 20.

It should be understood that frame 22 maybe constructed in a wide variety of configurations and structures. The particular frame 22 illustrated is convenient and preferred.

In accordance with the invention, a mandrel is provided for holding a workpiece. Still in reference to FIG. 1 one preferred mandrel is shown generally at 40. Mandrel 40 is constructed to support a tubular construction in order to permit the installation and application of fibrous packing. By "tubular construction" it is meant a structure having an outer surrounding wall that forms a closed, or substantially closed region. A tubular construction may have a circular cross-section, and thereby be cylindrical, an oval cross-section, or a rectangular construction, to name a few examples. A tubular construction may have other cross-sectional shapes. The mandrel 40 is constructed and arranged to support and hold a tubular construction of the desired shape and size.

Preferably, mandrel 40 has an outer wall 42. In the embodiment shown, wall 42 is cylindrical and has a circular cross-section. Wall 42 preferably defines a plurality of apertures 46 providing airflow communication with the interior 44 (FIG. 5) of the mandrel 40. In general, there are between 1–1000 apertures 46, preferably about 12 apertures. Apertures 46 comprise a total open area of about 1–50%, typically about 10% of the total surface area of the mandrel outer wall 42. By "total surface area", it is meant the enclosed surface area of the mandrel between the hubs of the sealing arrangement and without subtracting the areas of the apertures 46. Preferably, the open area will be sufficient to provide vacuum flow. This will be dependent on the area, size, and leakage rate, for example.

Preferably, wall 42 of mandrel 40 is constructed of metal, such as steel, for example 16 ga. or heavier steel tubing.

In accordance with the invention, the apparatus 20 includes a sealing arrangement for providing a seal between the mandrel 40 and the workpiece or tubular construction, when a workpiece or tubular construction is mounted on the mandrel 40. As embodied herein, one example sealing arrangement is shown generally at 60. Sealing arrangement 60 is preferably selectively activated such that seals may be formed and unformed when desired. In reference to FIG. 4, a pair of hubs 64, 66 is shown for supporting the seal members and for holding the workpiece or tubular construction. Preferably, as shown in the example embodiment illustrated, each of the hubs 64, 66 includes a pair of circular disks 70, 71 and 72, 73, respectively. Each of the respective disk pairs is preferably connected together or joined by a plurality of bolts 75. In other embodiments, the hubs 64, 66 are non-circular in shape, such as oval, to accommodate whatever shape the workpiece is.

Figure 5:
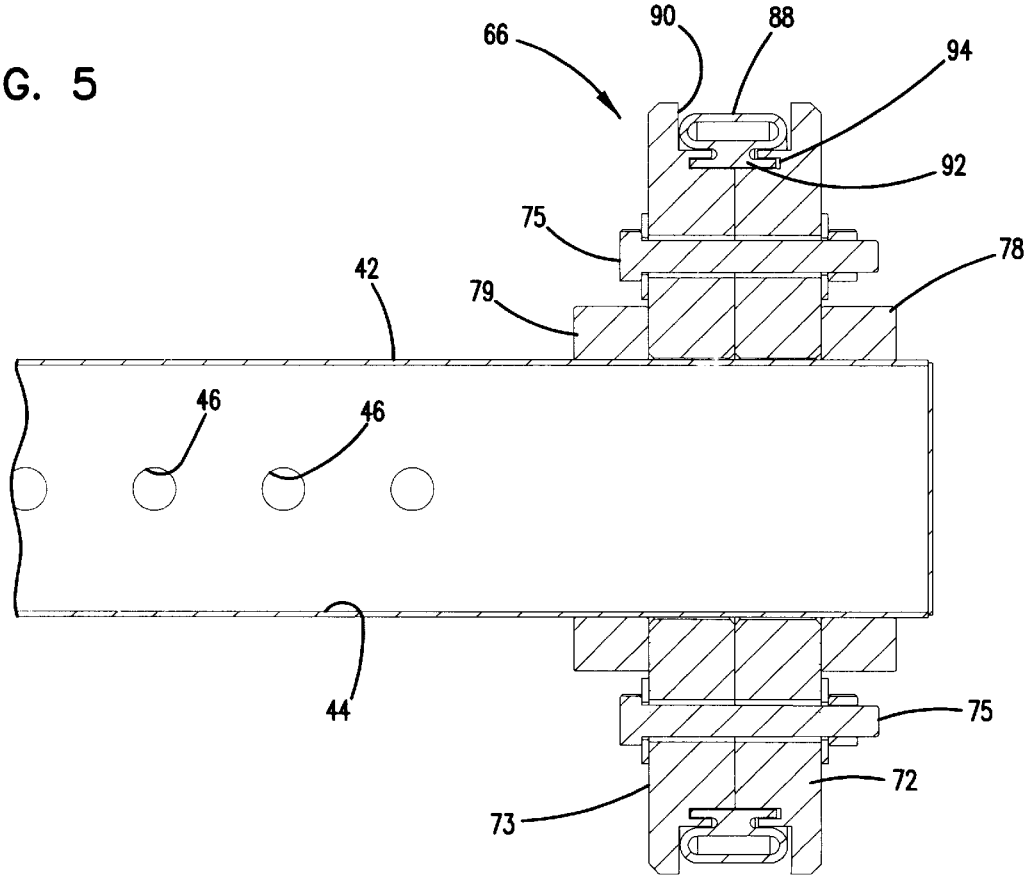
FIG. 5 is an enlarged, fragmented, cross-sectional view of a portion of the mandrel and one of the hubs with seal members as shown in FIG. 4, according to principles of the present invention.
Figure 4:
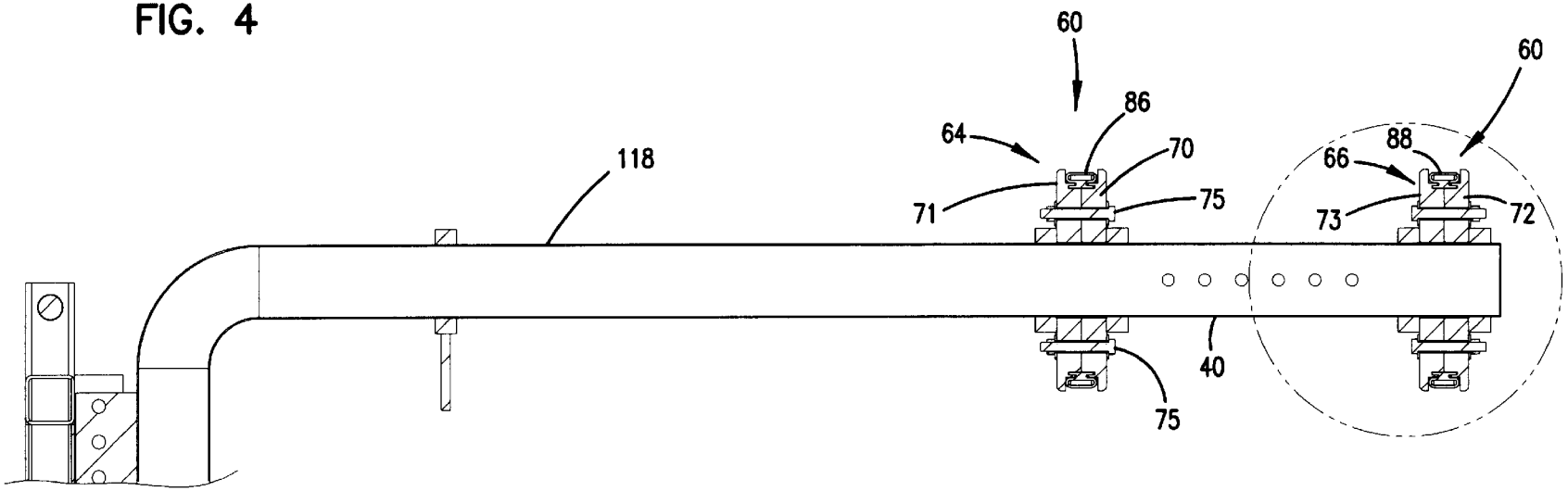
FIG. 4 is a fragmented, cross-sectional view of the section 4-4, depicted in FIG. 3, and showing a perforated mandrel and sealing arrangement, according to principles of the present invention.
Figure 6:
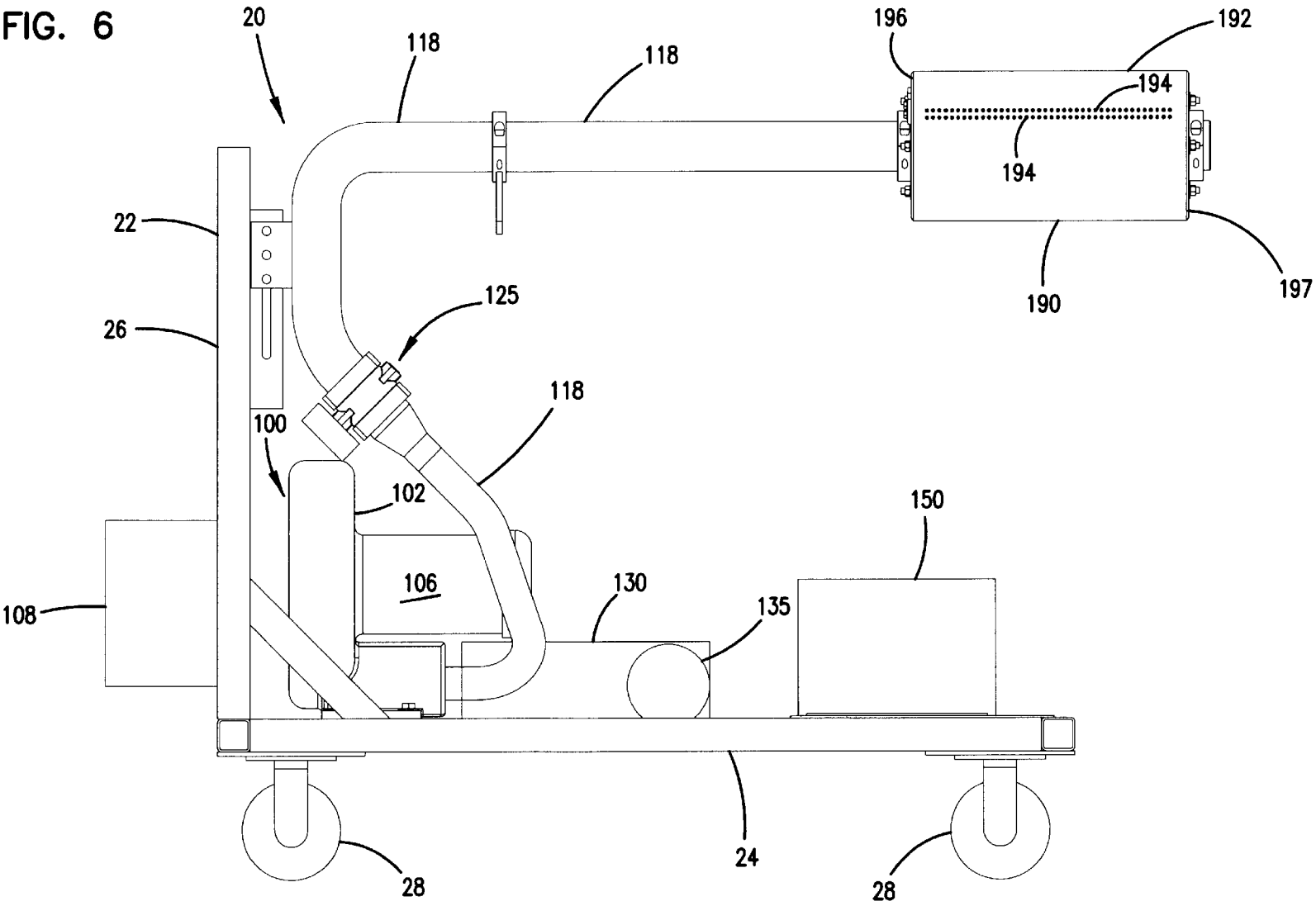
FIG. 6 is a side elevational view of the apparatus depicted in FIG. 1, similar to the view shown in FIG. 2, but including a first tubular construction or perforated muffler wall mounted on the mandrel, according to principles of the present invention.

Attention is directed to FIG. 5. In FIG. 5, there is a fragmented, enlarged cross-sectional view of hub 66. As can be seen in FIG. 5, disks 72, 73 preferably define a circular central hole or aperture for accommodating the wall 42 of the mandrel 40. The preferred hub 66 also includes a pair of fitments or bushings 78, 79 for helping to hold the hub 66 in place over the wall 42. Hubs 64, 66 are preferably constructed of metallic or plastic material capable of withstanding wear of application. For example, hard coated aluminum or steel can be used.

Referring again to FIG. 4, it can be seen that each of the hubs 64, 66 supports and holds a sealing member 86, 88, respectively. Preferably, seal members 86, 88 are ring shaped and fit within the seal member seat 90, FIG. 5, formed by the hubs 64, 66.

In reference to FIG. 5, the preferred seal members 86, 88 include a tongue 92 for slidably fitting within a groove 94 formed by the mating disks 70, 71 and 72, 73 of each of the hubs 64, 66 respectively. The seal members 86, 88 preferably are selectively enlargable. That is, the seal members 86, 88 can be, for example, inflated and deflated to enlarge or decrease the volume occupied by the seal members 86, 88. As can be seen, the seal members 86, 88 are recessed within each of the respective hubs 64, 66. The recessed nature of the seal members 86, 88 ensures that there is no damage to or minimal contact (friction) with the seal members 86, 88 when a tubular construction, such as a perforated muffler wall 190 (FIG. 6) is moved over or slid over the hubs 64, 66. As is explained below, the seal members 86, 88 are enlarged to form a seal between the tubular construction 190 and the seal members 86, 88.

One useable type of seal member is commercially available from Presray Corp. from Prawling of New York. Those skilled in the art will recognize that other types of sealing arrangements and methods can be used.

In accordance with the invention, a pump apparatus is provided in airflow communication with the mandrel 40 to induce a sub atmospheric pressure (or partial vacuum) in the mandrel interior 44 and through the apertures 46. In reference again to FIG. 1, one example pump apparatus is shown generally at 100. Pump 100 preferably comprises a vacuum pump 102 having a power at least about 1 HP to no more than about 20 HP, typically about 10 HP.

Vacuum pump 102 is in airflow communication with the mandrel interior 44 such that it induces a negative gauge pressure or a partial vacuum of from about −0.5" Hg. to −15" Hg. gauge, typically about −6.0 Hg. gauge. One useable vacuum pump is a Fuji regenerative blower commercially available from Grainger of Minnesota.

Vacuum pump 102 is powered by a motor 106 that is preferably an integral part of vacuum pump 102. Preferably, motor 106 comprises a three-phase motor. A disconnect and a starter for motor 106 is provided at 108.

As can be seen in FIG. 1, vacuum pump 102 is put in airflow communication with mandrel interior 44 by way of conduit system 116. In the embodiment illustrated, conduit system 116 includes a series of pipes or conduits 118 connected together to convey the sub-atmospheric pressure from the pump 102 to the mandrel interior 44. Conduits 118 may be constructed of a steel material, for example 16 ga. steel tubing.

Conduit system 116 has mounted therein a butterfly valve 125. Valve 125 is for controlling the air flow conveyed from the vacuum pump 102 to the mandrel interior 44. Further, valve 125 is for turning the vacuum on and off in the mandrel interior. One suitable vacuum valve 125 is a JKC 75 mm, commercially available from JKC of Japan.

Still in reference to FIG. 1, in the preferred embodiment, a silencer 130 is provided. Silencer 130 operates to muffle or quiet the sound generated by the vacuum pump 102. In general, silencer 130 is a fiberglass packed muffler for high frequency noise attenuation generated by the vacuum blower. One useable silencer 130 is a Fuji VFY-028A, commercially available from Grainger of Minnesota.

Still in reference to FIG. 1, a dust collector 135 is provided. Dust collector 135 is preferably attached in airflow communication with the silencer 130. Dust collector 135 functions to trap loose fibers entrained in the flow when installing the packing or fiber wrap onto the cylindrical member. One useable dust collector 135 is a Donaldson FW A05 2526 commercially available from the assignee of this invention, Donaldson Co. Inc. of Bloomington, Minn.

Figure 10:
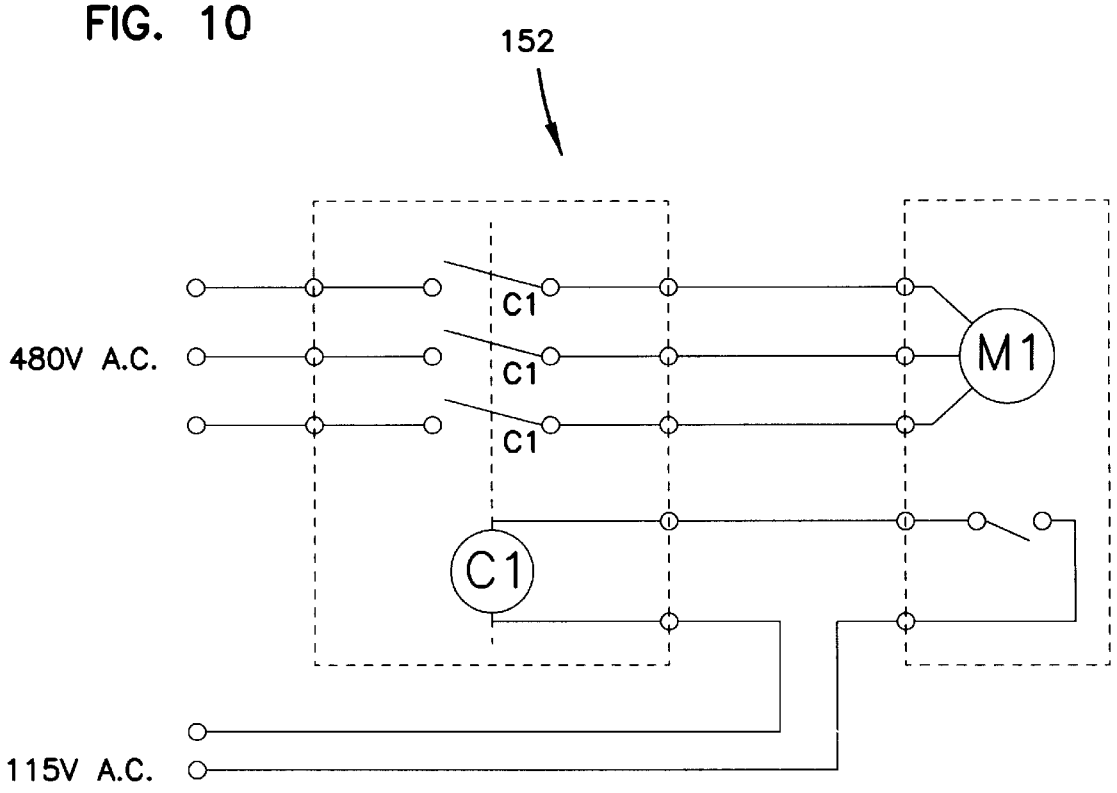
FIG. 10 is a schematic depicting a magnetic control system of the apparatus shown in FIGS. 1–7, according to principles of the present invention.
Figure 9:
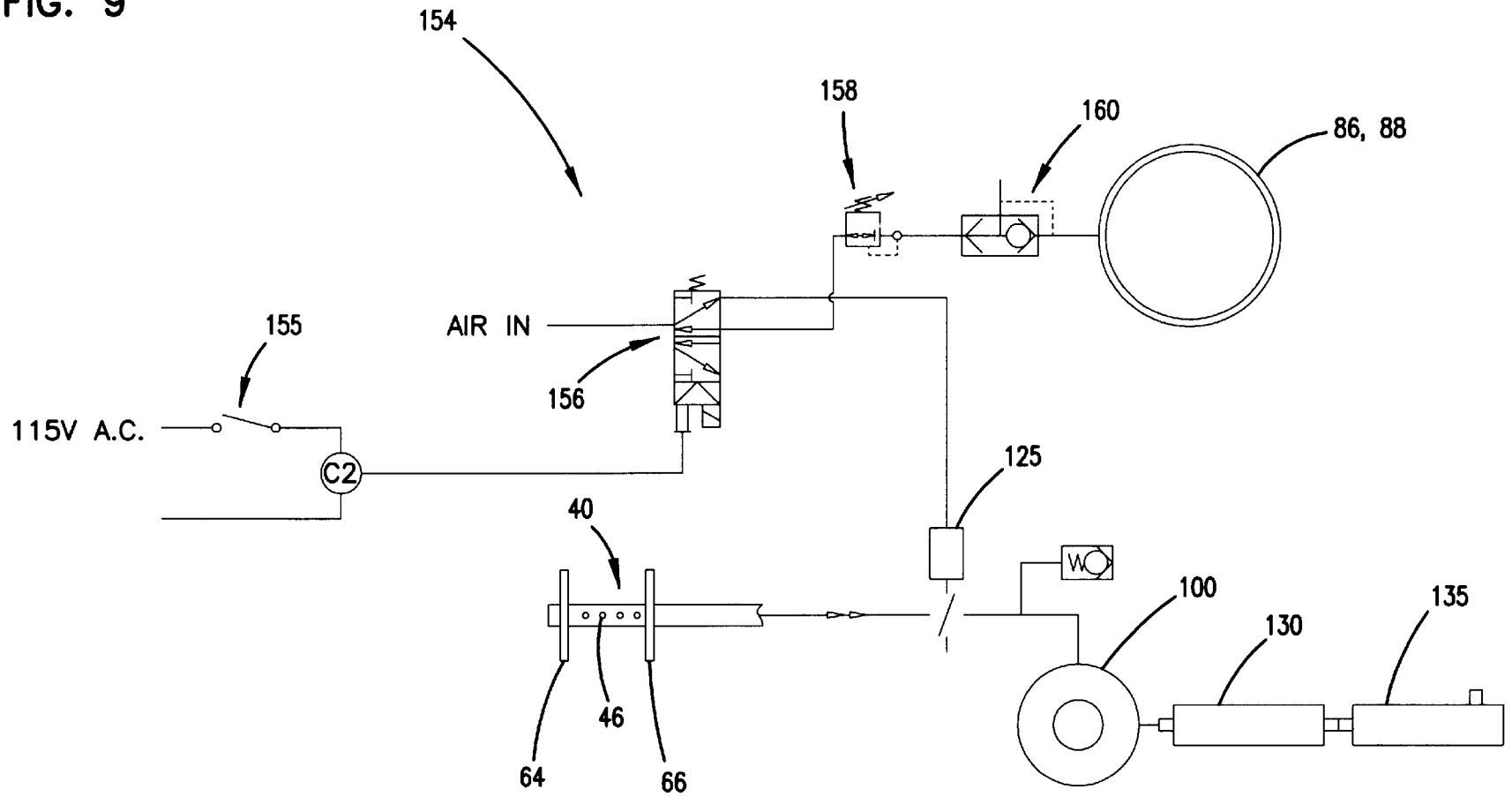
FIG. 9 is a schematic depicting a control system for the apparatus shown in FIGS. 1–7, according to principles of the present invention.

In accordance with the invention, the apparatus 20 is controllable to control the operation (i.e., the inflation and deflation) of the seal members 86, 88; the butterfly valve 125; the general on/off power; and vacuum pump 102. As embodied herein, a control box 150 is preferably mounted on the frame deck 24. Turning now to FIGS. 9 and 10, a schematic is shown depicting the controls in the control box 150.

In FIG. 10, a schematic showing the magnetic motor starter is illustrated generally at 152. System 152 turns the vacuum pump 102 on for continuous operation during use of the apparatus 20, such as during an assembly of muffler bodies. The magnetic starter can be adjusted as required by local electrical codes for the size of the motor. In FIG. 9, a schematic showing the system operations and control is shown generally at 154. At 155 is a latching foot switch to control a solenoid valve, which operates the vacuum cycle. When the foot switch 155 is in an "off" position, the system is ready to start an assembly cycle. The vacuum blower is on and vented through a vacuum breaker valve to provide coolant flow to the blower. Once the user desires to induce a partial vacuum through the mandrel 40, the foot switch 155 is moved to an "on" position. The foot switch 155 activates an air solenoid 156. Solenoid 156 activates the normally closed butterfly valve 125. Compressed air flows to the butterfly valve 125 to open the valve 125. Flow at partial vacuum is routed though the mandrel 40 to the holes 46 between the hubs 64, 66. Minimum air flow through the blower is ensured by the vacuum relief valve 158. The solenoid 156 simultaneously activates the seal members 86, 88. Compressed air flows to the air regulator, and the air regulator regulates the inflation pressure provided to the seal members 86, 88. The seal members 86, 88 inflate at a predetermined pressure to provide a vacuum seal between the hubs 64, 66 and the tubular construction, such as tubular construction 190. With the foot switch 155 in the "on" position, the desired processes are performed. Once the processes are completed, the foot switch 155 is moved to the "off" position. This causes vacuum flow through the assembly to be terminated by closure of the butterfly valve 125. Pressure to the seal members 86, 88 is turned off and vented through a quick exhaust valve 160. Minimum bleed flow to the blower 100 is provided by the vacuum relief valve. The assembly may be removed from the mandrel. The cycle may then be restarted with the appropriate new materials, as explained below.

C. Example Processes

Figure 8:
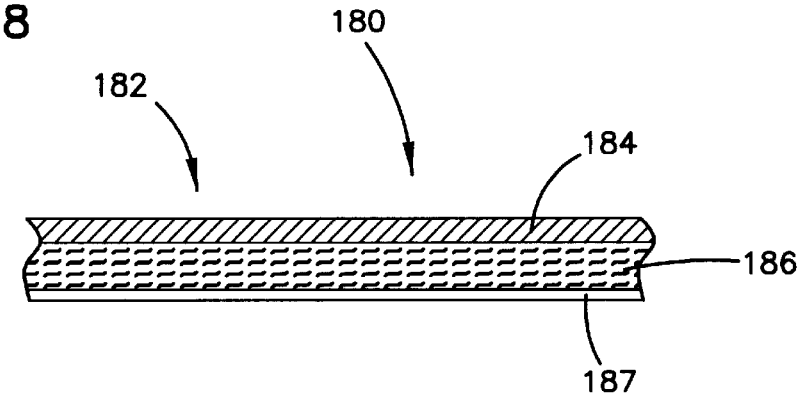
FIG. 8 is a cross-sectional view of a fiber wrap or packing material usable with the arrangements of the FIGS. 1–7, according to principles of the present invention.

Attention is now directed to FIG. 8. In FIG. 8, a schematic, cross-sectional view of a packing is shown generally at 180. While packing 180 may comprise a variety of structures and compositions, in the particular embodiment illustrated, packing 180 is shown as a fibrous mat 182. Mat 182 comprises a backing 184 and non-woven fibers 186 attached adhesively to backing 184. Preferably, backing 184 comprises an impervious material such that it is susceptible to having a vacuum drawn against it. In addition, in certain embodiments, backing 184 permits it to be handled by a robot arm, such as vacuum cups on a robot arm. Preferably, non-woven fibers 186 comprise material that will expand within an enclosed region where it is installed. Preferably, non-woven fibers 186 will function to absorb sound waves, provide damping functions, provide thermal insulation, or some combination of these functions. In some instances, there is an additional layer 187 adjacent to the layer of non-woven fibers 186. Layer 187 may comprise a material to prevent erosion of the non-woven fibers 186. For example, layer 186 may comprise a woven cloth backing that is needled into the mat of non-woven fibers 186.

One fibrous mat 182 usable is E-Glass commercially available from Bay Insulation of Green Bay, Wis. It comprises fibrous glass 98.7% by weight having a specific gravity of 2.5. Specifically, mat 182 may comprise fibers having an average fiber diameter of about 0.0089 mm.

Preferably, if a cloth backing 187 is utilized, the cloth 187 will have a weight of about 322 g/m$^2$. A lighter weight cloth may also be used, that has a weight of about 183 g/m$^2$.

One example material for backing 184 is a polyfilm available from Paragon Films of Broken Arrow, Okla. The film is preferably polyethylene and polybutene available under the product name "Force II Stretch Film". The film 184 has a specific gravity of about 0.91–0.97, and has a transparent appearance.

As to the performance of the apparatus 20 and conducting of the processes, there is no particular preference for the mat 182, cloth backing 187, and film backing 184. The ones provided above are examples that are usable and convenient.

A process for installing packing 180 in an enclosed tubular construction, such as a muffler subassembly is described below. In general, the process compresses a mat of packing material by removing a portion of air from the packing material; orients the mat against a tubular construction wall; and an outer tubular construction is placed thereover. More specifically, the mat is compressed by drawing a vacuum through the tubular construction wall and placing the packing over and against the wall. Details of this process are described below.

Figure 2:
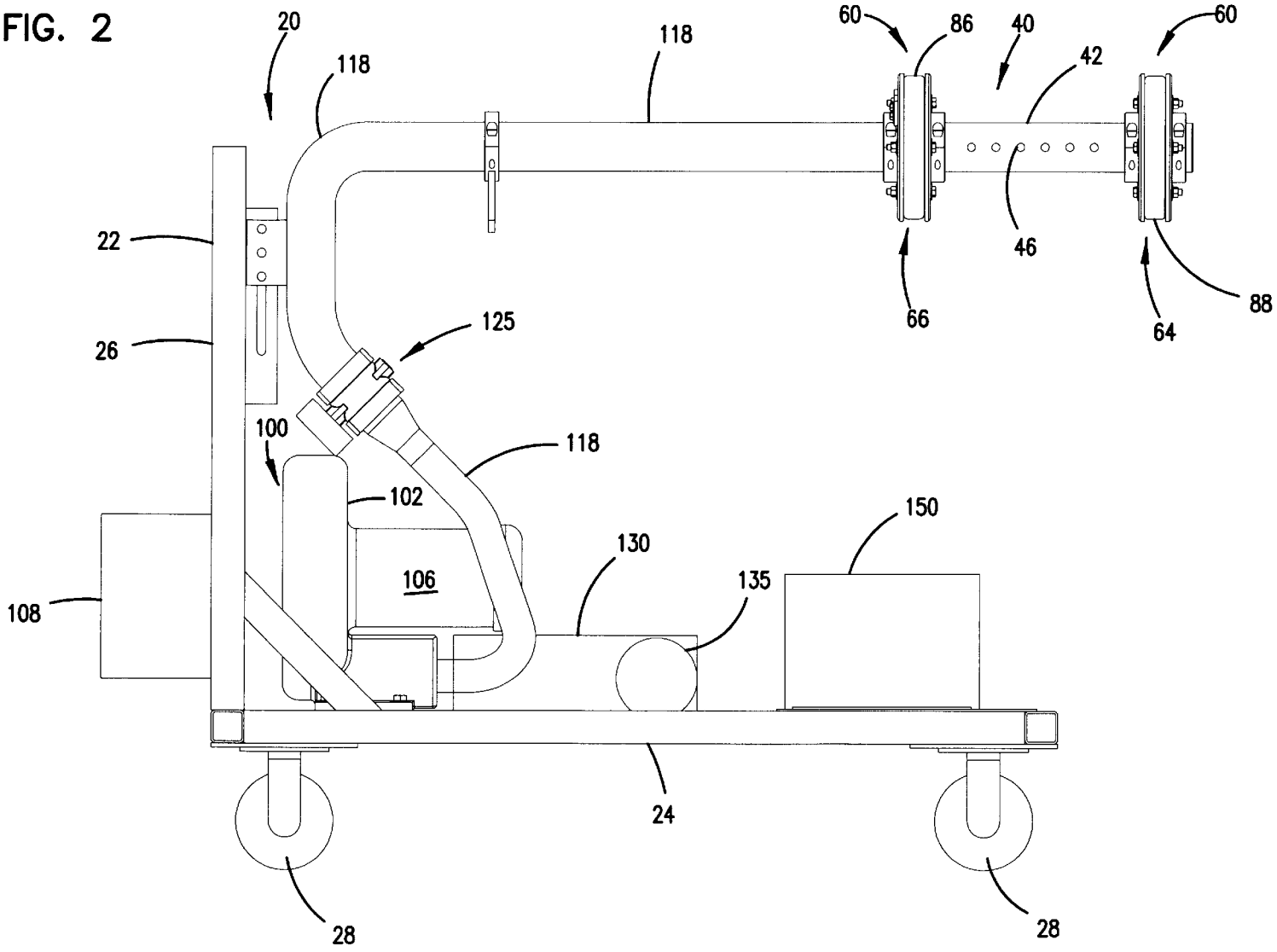
FIG. 2 is a rear side elevational view of the embodiment of FIG. 1, according to principles of the present invention.
Figure 3:
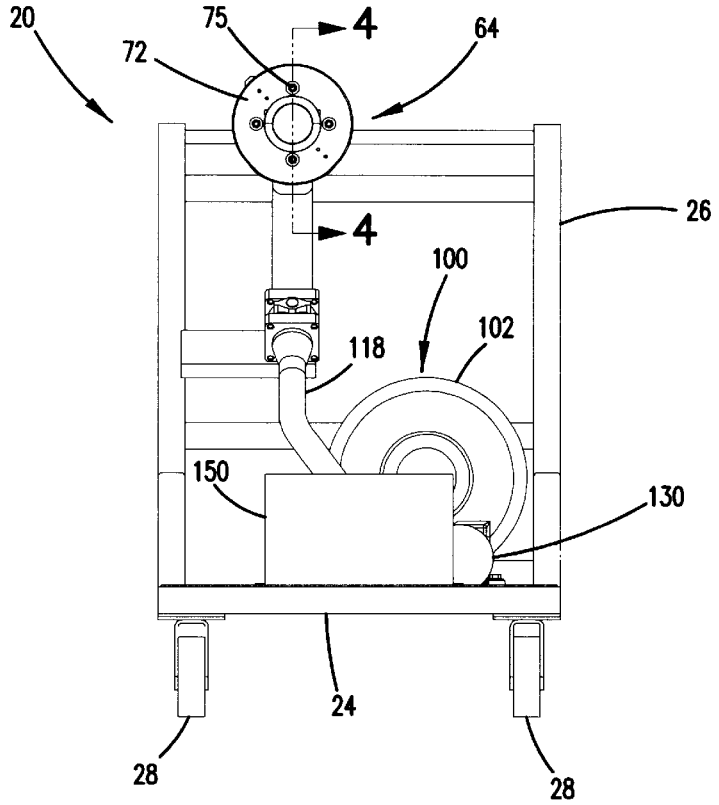
FIG. 3 is a front side elevational view of the embodiment of FIG. 1, according to principles of the present invention.

Initially, an apparatus is provided to hold the tubular construction and to draw a partial vacuum through the tubular construction. One example apparatus includes apparatus 20 as shown in FIGS. 1–7. For example, apparatus 20 as shown in FIG. 2 would be provided.

Next the tubular construction would be mounted in the work holder or mandrel 40. For example, a tubular construction such as perforated muffler wall 190 may generally include surrounding wall 192 defining apertures or perforations 194. Tubular construction 190 may be open on both ends. To mount the tubular construction 190 on the mandrel 40, a first end 196 of the tubular construction is placed around and over the hub 64 and moved until the first end 196 is over hub 66 and a second end 197 of the tubular construction 190 is over the hub 64. In some embodiments, a stop member may be used to provide a positive stop surface for the first end 196 of hub 66. Of course, the distance between hubs 64 and 66 may be adjusted to accommodate varying axial lengths of the tubular construction 190. Further, the hubs 64, 66 are interchangeable with hubs of other sizes and shapes, depending on the tubular construction size and shape.

Next, a seal is formed between the tubular construction 190 and the mandrel 40. One way of accomplishing this step is by inflating the seal members 86, 88 ( FIG. 4 ) in the sealing arrangement 60. When the seal members 86, 88 are inflated, there is an airtight seal 198, 199 formed between the inner surface of the wall 192 and the seal members 86, 88.

Next, a partial vacuum is drawn through the wall 192 of the tubular construction 190. This may be accomplished by operating the vacuum pump 102. Preferably, the partial vacuum is drawn at the same time that the seal is formed between the inner surface of the wall 192 and the seal members 86, 88. For example, if a foot pedal is used, when the operator steps on the foot pedal, the seal members 86, 88 are inflated to form the seals 198, 199 and to operate the vacuum pump 102 to draw a partial vacuum through the mandrel. The vacuum pump 102 creates a partial vacuum, or subatmospheric pressure, through the conduit system 116 and ultimately draws flow at negative gauge pressure through the apertures 46 and the mandrel 40. Because of the seals 198, 199 formed by the sealing arrangement 60, the negative gauge pressure is then conveyed through the perforations 194 in the wall 192. Preferred operating pressures for vacuum pump 102 are from about −0.5" Hg. to −15" Hg. typically −6.0" Hg. gauge. These conditions cause impervious backing 184 to compress the fiberglass mat to about twice its density and half its thickness as described below.

Of course, it should be understood that the steps of mounting the tubular construction, forming the seal, and operating the vacuum pump 102 may be performed in any order.

Next, a mat of packing material is oriented over and against the wall 192. For example, a packing 180 such as a fibrous mat 182 would be wrapped around the tubular construction wall 192. Specifically, the layer of non-woven fibers 186 would preferably be placed on and against the wall 192. The partial vacuum pressure then would function to compress the fibrous mat 182 tightly against the wall 192. In particular, the partial vacuum draws in the impervious backing 184 toward the wall 192. This helps to flatten and compress the layer 186 of fibrous material. Further, this step of applying a fibrous mat over and against the wall 192 may include using a robot arm to pick up the mat 182 and place it on the wall 192. Preferably, the mat 182 is pre-formed into sections cut to fit the surface area of wall 192 of the tubular construction 190. In one example embodiment, each of the fibrous mats 182 is cut rectangular with dimensions of 30.19 in. by 16.62 in. and a thickness free state (that is, absent the influence of any vacuum) of about 0.5 in. After applying the mat 182 to the partial vacuum on the wall 192, the fibrous mat 182 is compressed down to a thickness of about 0.30 in. That is, preferably it is compressed to about 50–75%, typically 60% of its original thickness.

Figure 7:
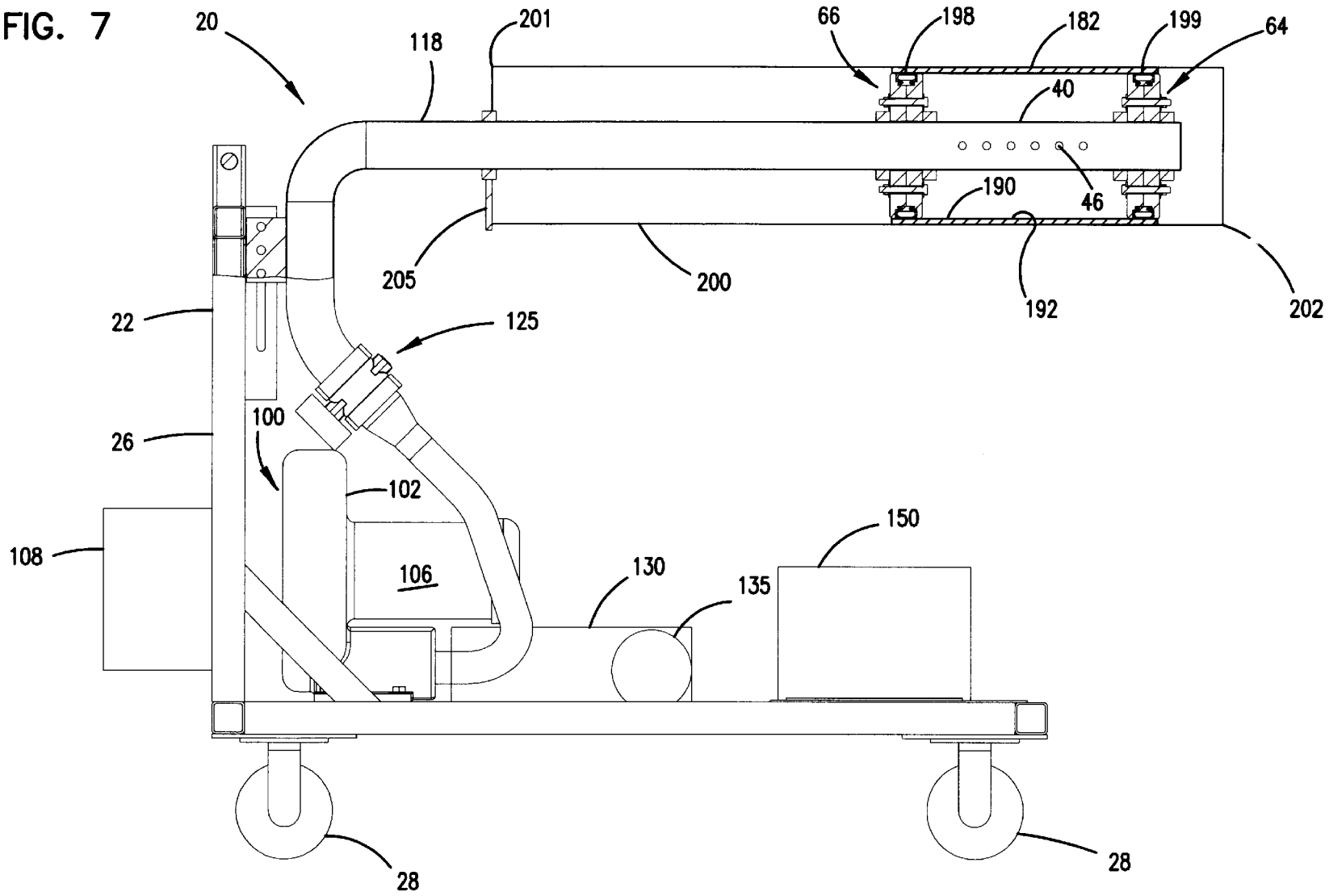
FIG. 7 is a side elevational view similar to FIG. 6 and showing the first tubular construction wrapped with packing material and a second tubular construction thereover, according to principles of the present invention.

After the step of orienting the fibrous mat over the perforated wall 192, preferably there is a step of orienting an outer tubular construction over the fibrous mat. Attention is directed to FIG. 7. In FIG. 7, one example outer tubular construction is illustrated as an outer shell 200. Shell 200 has a first end at 201 and a second end at 202. The first end 201 is preferably placed over and around the hub 64, and the shell 200 is slid over the subassembly including the fibrous mat 182 (that is mounted and drawn against the tubular construction wall 192). The shell 200 is adjusted until the first end 201 is moved against the stop 205. Of course, stop 205 is optional and can be adjusted based upon the axial length of the shell 200. As the outer shell 200 is slid over the fibrous mat 182, the distance between the shell 200 and the mat 182 is about 0–0.12 in., typically about 0.070 in.

After the shell 200 is mounted as shown in FIG. 7, the vacuum pump 102 may be turned off, or the vacuum valve 125 may be adjusted to stop the induction of partial vacuum through the perforated wall 192. For example, the foot pedal 155 may be switched to the "off" position. This terminates the flow of air through the mandrel 40 by closing the butterfly valve 125. This also turns off pressure to the seal members 86, 88. After the partial vacuum is turned off and discontinued through the perforated wall 192, the non-woven fibers 186 expand to fill the space between the wall 192 and the shell 200. In addition, the seals between the tubular construction 190 and the seal members 86, 88 would be broken. This may be accomplished by deflating the seal members 86, 88.

After the seals have been broken, the resulting assembly of the tubular construction 190, fibrous mat 182 and outer shell 200 would be removed from the apparatus 20. This would be accomplished by sliding the completed assembly off of the mandrel 40.

The total time for assembling a typical subassembly as described is under 1 minute, typically under ½ minute (30 seconds). Attention is directed to the following example:

A tubular construction 190 has a diameter of about 9.23 in., an axial length of about 16.6 in., and a weight of about 4.6 lb/m. A fibrous mat 182 has a length of about 30.19 in., a width of about 16.6 in., and a thickness free state of about 0.5 in. An outer shell 200 has a diameter of about 10.06 in., and axial length of about 44.25 in., and a weight of about 14.9 lb/m. The tubular constuction 190 is wrapped with the fibrous mat 182, and the outer shell 200 is placed thereover to form a subassembly. Using a vacuum pressure of about 6 in. Hg., there can be at least 25 subassemblies produced within 1 hour. Typically, there will be about 25–100 subassemblies produced within 1 hour.

The resulting subassemblies have a tight, close fit between the wall 192 and shell 200, such that there is a reduction in noise generated from rattling and vibration. Further, there is improved acoustical performance from the fiberglass due to proper control of glass density; reduced assembly time; improved operator comfort due to minimized handling of glass and removal of stray glass fibers through the blower and collection by the filter; improved muffler performance through improved control of chamber diameters not required to fit over taped glass mats.

D. The Apparatus of FIGS. 11 and 12

Figure 11:
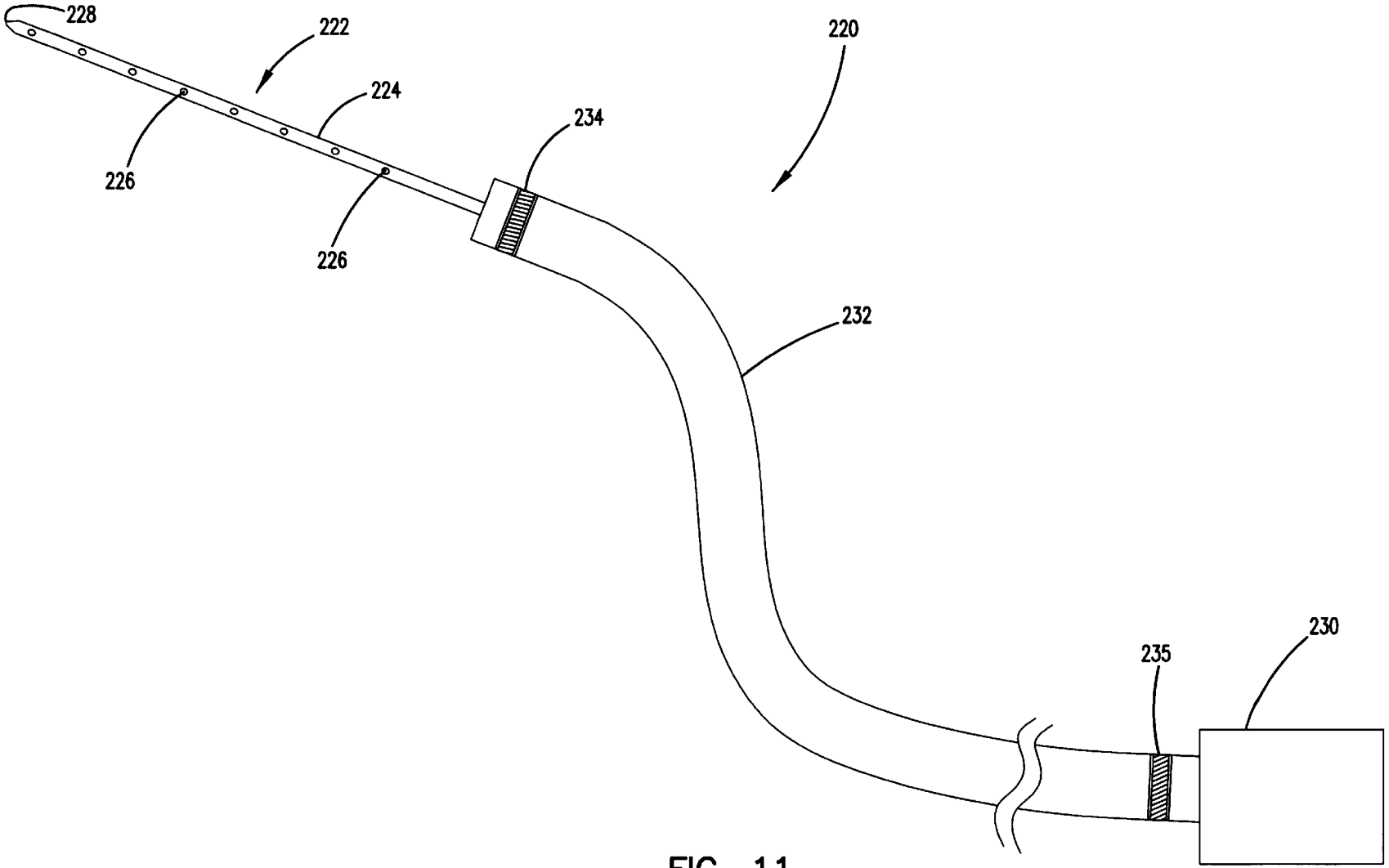
FIG. 11 is a side elevational, somewhat schematic, view of an alternate embodiment of an apparatus according to principles of the present invention.
Figure 12:
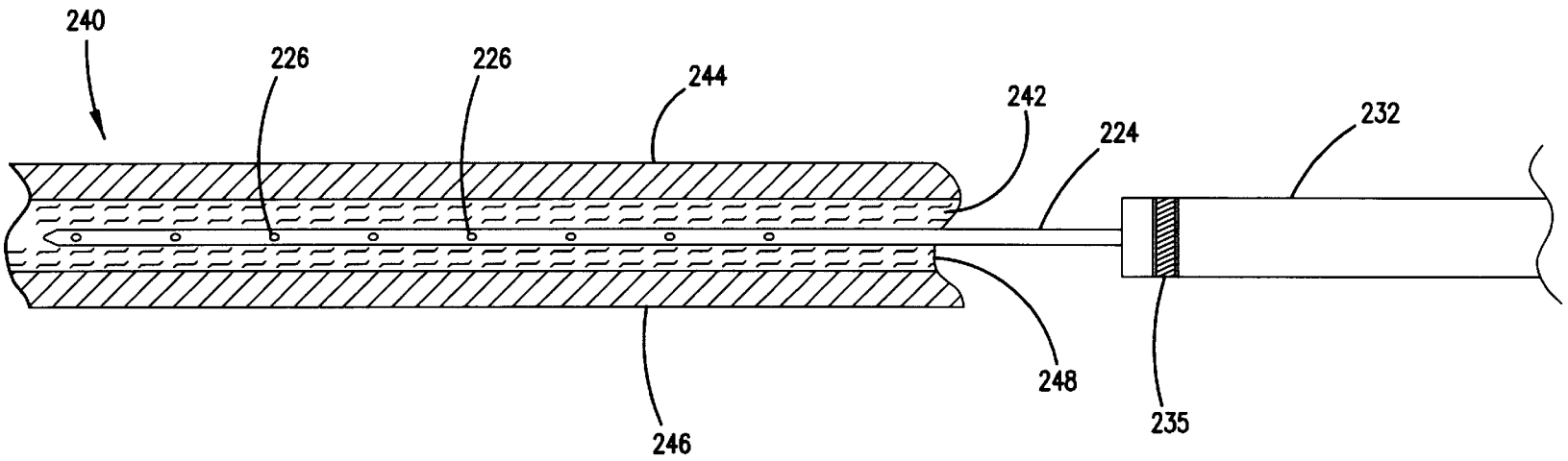
FIG. 12 is a schematic, partially cross-sectional view of the apparatus of FIG. 11 being used with a fiber wrap or packing material, according to principles of the present invention.

Attention is directed to FIGS. 11 and 12. In FIG. 11, an alternate embodiment of an apparatus constructed in accordance with the present invention is illustrated generally at 220.

In the example embodiment illustrated in FIG. 11, apparatus 220 includes a system for inducing a partial vacuum in order to compress a fibrous mat. For example, apparatus 220 includes a vacuum member 222. Vacuum member 222 operates to draw a vacuum in a region adjacent to wherever it is positioned. In the specific embodiment illustrated, vacuum member 222 comprises a probe member or wand 224. Wand 224 may take the form of an elongate member with a plurality of perforations 226. Perforations 226 allow for the passage of air flow to pass therethrough, to generate a partial vacuum.

Still referring to FIG. 11, wand 224 includes a system for introducing the wand 224 into a fibrous mat. The system may include a variety of mechanisms. In the particular embodiment illustrated, the system includes a converging tip, or sharpened point, or spike 228. Spike 228 permits the periphery of a fibrous mat to be punctured to allow for the introduction of the wand 224 therein.

Still referring to FIG. 11, apparatus 220 preferably includes a vacuum pump 230. One preferred vacuum pump can be a Gast air compressor, Part No. 4F742. A flex hose 232 may be used to convey the air flow between the wand 222 and the vacuum pump 230. Also, a pair of band clamps 234, 235 are illustrated as providing a seal between the flex hose 232 and the wand 222 and vacuum pump 230, respectively.

Attention is directed to FIG. 12. In FIG. 12, an illustration of the apparatus 220 is shown inducing a partial vacuum in a mat of packing material 240. Packing material 240 may be analogous to that as described in conjunction with packing 180 in FIG. 8. Packing material 240 may comprise a layer of non-woven fibers 242 and an impervious backing 244. In addition, in the embodiment of FIG. 12, the mat 240 includes an additional layer of impervious backing at 246. The layers of impervious backing 244, 246 are for allowing a vacuum to be induced in the layer of non-woven fibers 242. In addition, if desired, robot control may be used to handle the mat 240 due to the impervious backings 244, 246.

Still in reference to FIG. 12, the wand 224 is shown inserted into the layer of non-woven fibers 242. This allows partial vacuum to be passed through the perforations 226 and into the layer of non-woven fibers 242. The partial vacuum causes the layer of non-woven fibers 242 to compress. This is because the impervious backings 244, 246 do not allow, for the most part, air to pass through, and air is removed between the fibers in the layer 242 causing atmospheric pressure to compress the mat.

In operation, one example process for the apparatus of FIGS. 11 and 12 is as follows. A mat of packing material, such as packing material 240 is provided. The mat of packing material is compressed by removing at least a portion of air from the mat. This may be accomplished by inserting the wand 224 into the periphery 248 of the packing material 240. This may be done, for example, by puncturing the periphery 248 with the spike 228. The wand 224 is slid through the layer of non-woven fibers 242. A partial vacuum may then be induced by operating the vacuum pump 230. This may be controlled by a switch, such as a foot pedal. The partial vacuum is conveyed through the flex hose 232 and into the wand 224. The partial vacuum is drawn through the perforations 226 and into the layer of non-woven fibers 242. Air in the layer of non-woven fibers 242 is drawn out, which causes the packing material 240 to compress in thickness, by the surrounding atmospheric pressure on the impervious backing 244 and 246.

This compressed mat of packing 240 may then be manipulated in an assembly process. For example, the compressed mat 240 may be oriented against or wrapped era around a tubular construction, such as a shell of a muffler. The shell may or may not be perforated. The mat is then secured to the muffler shell, for example with tape. Alternatively, the tubular construction may have an adhesive already applied, and the compressed mat 240 is applied thereto.

After the mat 240 is secured to the tubular construction, an outer tubular construction, such as an outer muffler shell may be mounted thereover. This may be done by sliding the outer tubular construction over the mat 240. After the outer shell is oriented in position around the packing 240, the wand 224 may be withdrawn from the layer 242. In addition, if desired, before withdrawing the wand 224 from the layer 242, compressed air can be introduced into the layer of non-woven fibers 242. This will fluff up or increase the volume to fill the space between the inner and outer tubular constructions.

In operation in both the embodiments of FIGS. 1–10 and FIGS. 11–12, the layers of impervious backing of the packing material preferably melt during operation of the muffler.

Apparatus 220 preferably is for compressing a packing material with two impervious surfaces, such as a fibrous mat into a form that may be easily handled and manipulated.

The above description represents certain example embodiments of the invention.

Other embodiments of the invention may be made according to the principles described herein.

What is claimed is:

1. A process for installing a packing material in a tubular assembly; the process comprising:

(a) compressing a mat of packing material having an impervious backing by removing at least a portion of air from the mat of packing material, said step of compressing comprising:

(i) orienting a perforated tubular wall over a mandrel;

(ii) forming a seal between the perforated tubular wall and the mandrel by inflating a sealing tube between the mandrel and the perforated tubular wall;

(iii) drawing a partial vacuum through the perforated tubular wall after the perforated tubular wall is oriented over the mandrel;

(b) orienting the mat against the perforated tubular wall;

(i) said step of orienting including pressing the mat of packing material against the perforated tubular wall;

(c) after said step of orienting the mat, sliding a shell over and against the impervious backing;

(d) breaking the seal between the perforated tubular wall and the mandrel;

(i) said step of breaking the seal including deflating the sealing tube; and (e) removing an assembly comprising the perforated tubular wall, mat, and shell from the mandrel.

2. The process according to claim 1 wherein:

(a) said step of compressing a mat of packing material includes compressing a mat of non-woven fibrous glass.

3. The process according to claim 1 wherein:

(a) said step of drawing a partial vacuum through the perforated tubular wall includes drawing a vacuum to a pressure of about −0.5 inch Hg. to −15 inches Hg.

4. The process according to claim 1 wherein:

(a) said step of compressing a mat of packing material includes compressing the mat to about 50–75% of an original thickness of the mat.

5. The process according to claim 1 wherein:

(a) said step of sliding a shell includes sliding a shell having first and second opposite ends over and against the impervious backing.

6. The process according to claim 5 wherein:

(a) said step of sliding a shell includes sliding the shell until the first end engages a stop.

7. The process according to claim 1 further comprising after the step of breaking the seal between the perforated tubular wall and the mandrel:

(a) expanding the mat of packing material.

8. A process for installing a packing material in a tubular assembly; the process comprising:

(a) orienting a mat of packing material over a perforated tubular wall;

(b) orienting the perforated tubular wall over a mandrel;

(c) removing at least a portion of air from a region between the mat and the mandrel by:

(i) forming a seal between the perforated tubular wall and the mandrel by inflating a sealing tube between the mandrel and the tubular wall; and (ii) drawing a partial vacuum through the perforated tubular wall after the perforated tubular wall is oriented over the mandrel;

(d) after said step of removing at least a portion of air, orienting a shell over the mat; and (e) breaking the seal between the tubular wall and the mandrel by deflating the sealing tube.

9. The process according to claim 8 further including:

(a) after said of orienting the mat, orienting a shell over the mat of packing material.

10. The process according to claim 9 further including:

(a) removing an assembly from the mandrel including the perforated tubular wall, mat, and shell.

11. The process according to claim 8 wherein:

(a) said step of orienting a mat of packing material over a perforated tubular wall is done after said step of orienting the perforated tubular wall over a mandrel.

12. A process for installing a packing material in a tubular assembly; the process comprising:

(a) compressing a mat of packing material by removing at least a portion of air by:

(i) orienting a tubular wall over a mandrel;

(ii) forming a seal between the tubular wall and the mandrel by inflating a sealing tube between the mandrel and the tubular wall;

(iii) drawing a partial vacuum after the seal is formed;

(iv) orienting the mat of packing material against the tubular wall;

(b) after said step of compressing the mat, orienting a shell over and against the mat;

(c) breaking the seal between the tubular wall and the mandrel by deflating the sealing tube; and (d) removing an assembly comprising the tubular wall, mat, and shell from the mandrel.

13. The process according to claim 12 wherein:

(a) said step of orienting a tubular wall over a mandrel includes orienting a perforated tubular wall over a mandrel.

14. The process according to claim 12 wherein:

(a) said step of orienting a shell over the mat includes sliding a shell over the mat.

15. The process according to claim 14 wherein:

(a) said step of sliding a shell over the mat includes sliding the shell until the shell engages a stop member.

16. The process according to claim 12 wherein:

(a) said step of compressing a mat of packing material includes compressing a mat of packing material having at least one impervious backing; and (b) said step of orienting a shell over and against the mat includes orienting a shell over the at least one impervious backing.

* * * * *

UNITED STATES PATENT AND TRADEMARK OFFICE

CERTIFICATE OF CORRECTION

PATENT NO. : 6,148,519
DATED : November 21, 2000
INVENTOR(S) : Stenersen et al.

It is certified that error appears in the above-identified patent and that said Letters Patent is hereby corrected as shown below:

Title page,
ABSTRACT, line 17, after the word "pump", insert -- Certain embodiments may also include a dust collector and a silencer. Mufflers can be constructed according to the processes and apparatuses described. --

Column 10,
Line 27, delete "era" after the word "wrapped"
Line 53, delete "," after the word "certain"

Signed and Sealed this

Ninth Day of April, 2002

*Attest:*

*Attesting Officer*

JAMES E. ROGAN
*Director of the United States Patent and Trademark Office*